United States Patent [19]

Sullivan

[11] Patent Number: 4,912,887

[45] Date of Patent: Apr. 3, 1990

[54] PORTABLE STAGE APPARATUS

[76] Inventor: Brian J. Sullivan, 375 Donlin La., Newbury Park, Calif. 91320

[21] Appl. No.: 290,565

[22] Filed: Dec. 27, 1988

[51] Int. Cl.[4] ..... E04H 3/10

[52] U.S. Cl. ..... 52/7; 52/646

[58] Field of Search ..... 52/6, 7, 646

[56] References Cited

U.S. PATENT DOCUMENTS 3,091,816 6/1963 Wetzel ..... 52/7

*Primary Examiner*—David A. Scherbel
*Assistant Examiner*—Michele A. Van Patten
*Attorney, Agent, or Firm*—Jack Munro

[57] ABSTRACT

A portable stage apparatus which utilizes a plurality of open frame assemblies, each of which is constructed of a plurality of pivotally interconnected side panels. Each open frame assembly is mounted on wheels to facilitate movement from a collapsed position to an extended position. When in the extended position, a plurality of floor panels are to be mounted on the open frame assemblies with the floor panels being contiguous and the upper surface of the floor panels being in alignment. Adjoining floor panels are interlocked together with these floor panels also being locked to the open frame assemblies. For purposes of stowage and transportability, the open frame assemblies are connectable together in the collapsed position and readily movable onto a transporting vehicle. Also, a group of the floor panels are capable of being stowed together into a small space and mounted onto a storage dolly which is readily movable onto and off of a transporting vehicle.

15 Claims, 6 Drawing Sheets

PORTABLE STAGE APPARATUS

BACKGROUND OF THE INVENTION

The field of this invention relates to entertainment and more particular to the constructing of a portable stage which is capable of being transported with an entertainment group from one performance location to another performance location.

It is common that musical groups perform within a given city for a short period of time such as a few days or a week, and then move on to another city where again the performance time is repeated. Many times the facility in which the performance is given does not have a stage on which the performance is to be given or, the performer, for a reason, may not wish to use the stage provided by the facility. One reason would be that such stages are rented on a per day basis and the daily rate is most expensive.

Therefore, it has become quite common that performing groups have purchased their own stage. This stage is transported along with the performing group from city to city. The desirable features of having your own stage is that the rental of the stage is not required and the performing group begins to "know" their own stage. This knowledge of one's own stage makes the performance easier and increases the safety in conjunction with the usage of the stage.

In order to transport a stage from one city to another, the stage has :o be disassembled. Previous to the subject matter of this invention, the portable stages were constructed similar to an erector set. These stages were brought to the facility and assembled piece by piece with the pieces being bolted together. A typical stage is forty feet by sixty feet. To assemble such a stage would take ten hours or more with six or more people doing the assembly work. From a labor point of view, this assembly is very time consuming and inherently very expensive.

It is common that, upon a performing group completing a performance within a city with generally this performance terminating in the early hours of the morning, a crew begins to disassemble the stage immediately and work through the night to complete this disassembly. The now disassembled stage is placed upon a truck with the truck now being driven to the city of the next performance. Upon the arrival of the next performance site, the crew begins to assemble the stage with generally the assembly taking approximately ten hours. Because of the time period for the assembly and disassembly of the stage coupled with the traveling time, it is impossible for the performing group to give a performance that night in the new city. The first performance cannot be until the next day which means that a night of performance is lost. It is common that a single performance of a performing group would bring in a substantial amount of income. Therefore, this income is lost.

It would be desirable to design a portable stage which could be disassembled and assembled in a substantial shorter period of time thereby making it possible for the performing group to terminate their performance inone city and perform in another city the next night.

SUMMARY OF THE INVENTION

The portable stage apparatus of the present invention produces a planar stage performing surface located approximately four to six feet elevated from the supporting surface on which the stage apparatus is mounted. The stage can be constructed to be of any size with the typical size being forty by sixty feet. The base portion of the stage is provided through the use of a plurality of open frame assemblies with each open frame assembly being identical. Each open frame assembly is composed of a plurality of side panels with these side panels being pivotally interconnected along their vertically disposed edges. On the bottom edge of the side panels are mounted a plurality of wheels. These side panels can be manually moved from a position in juxtaposition to an extended position where the side panels enclose a given area. On the upper edge of the side pane]s are to be located a substantial number of floor panels with the upper surface of these floor panels being aligned so that the entire upper surface of the stage is flat. These floor panels are locked by means of a quick disconnect pin assembly to the side panels. Also, directly edge abutting floor panels are interlocked by a separate locking device. These floor panels are to be place on a floor panel storage dolly prior to usage. These storage dollies in and of themselves can be used adjacent to the stage to provide a step area to the stage or to provide equipment storage during the time the stage is being used. During assembly and disassembly of the stage, the total connections to connect together the stage is through the use of one type of pin thereby not requiring any conventional fastener such as a bolt.

The primary objective of the present invention is to construct a portable stage apparatus which can be readily assembled and disassembled within a short period of time.

Another objective of the present invention is to construct a stage apparatus in which the individual parts are interlocked together in such a manner as to provide maximum strength thereby minimizing the possibility of any accidents occurring due to reasons of collapsing of any portion of the stage apparatus.

Another objective of the present invention is to construct a stage apparatus which facilitates its manual movement onto and off of a transporting vehicle.

Another objective of the present invention is that the stage can be constructed at a location spaced from its final destination, loaded with the desired equipment, and then moved to its to be used location.

Another main objective of the present invention is that in its stowed position occupied s minimal amount of space.

BRIEF DESCRIPTION OF THE DRAWINGS

FIG. 14 is a front perspective view of a few of the storage dollies that are used to store the floor panels of the stage apparatus of the present invention with these dollies being in a layed down (non-upright) position to be utilized in conjunction with equipment alongside the stage or just to function as a step for the stage.

DETAILED DESCRIPTION OF THE SHOWN EMBODIMENT

Figure 1:
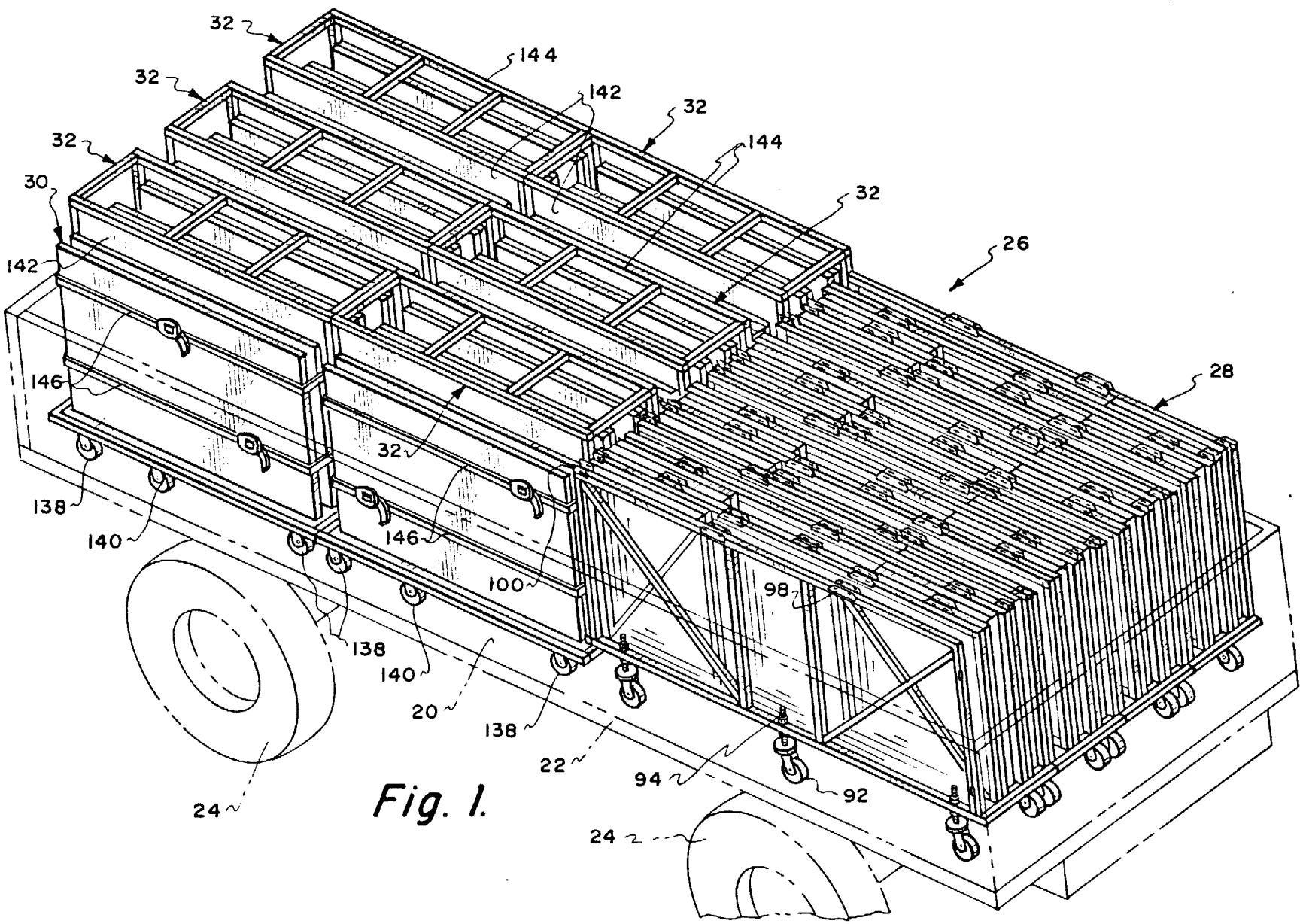
FIG. 1 is an isometric view of the disassembled stage apparatus of the present invention showing such being located on a transporting vehicle.

Referring particularly to Figure of the drawings, there is shown a load carrying platform 20 of a truck body 22. The truck body 22 is supported by wheels 24. It is to be understood that the body 22 is to be connected to a tractor for movement on a roadway to transport the portable stage apparatus 26 of this invention from one locale to another.

The stage apparatus 26 of this invention is basically composed of a plurality of open frame assemblies 28, a plurality of floor panels 30 and a plurality of floor panel carrying dollies 32. There are four in number of the open frame assemblies 28 shown within the drawings. However, it is considered to be within the scope of this invention that the number of open frame assemblies could be increased or decreased.

Each open frame assembly 28 is composed of a plurality of side panels 34, 36, 38, 40, 42, 44, 46, 48, 50, 52, 54, 56, 58 and 60. Each of the side panels 34 through 60 are constructed to be thin and planar and of a given length. The side panels 34, 40, 42, 48, 54 and 60 are all of the same length. Also, the side panels 36, 38, 44, 46, 50, 52, 56 and 58 are also of the same length with this length being shorter than the side panels previously mentioned.

Figure 3:
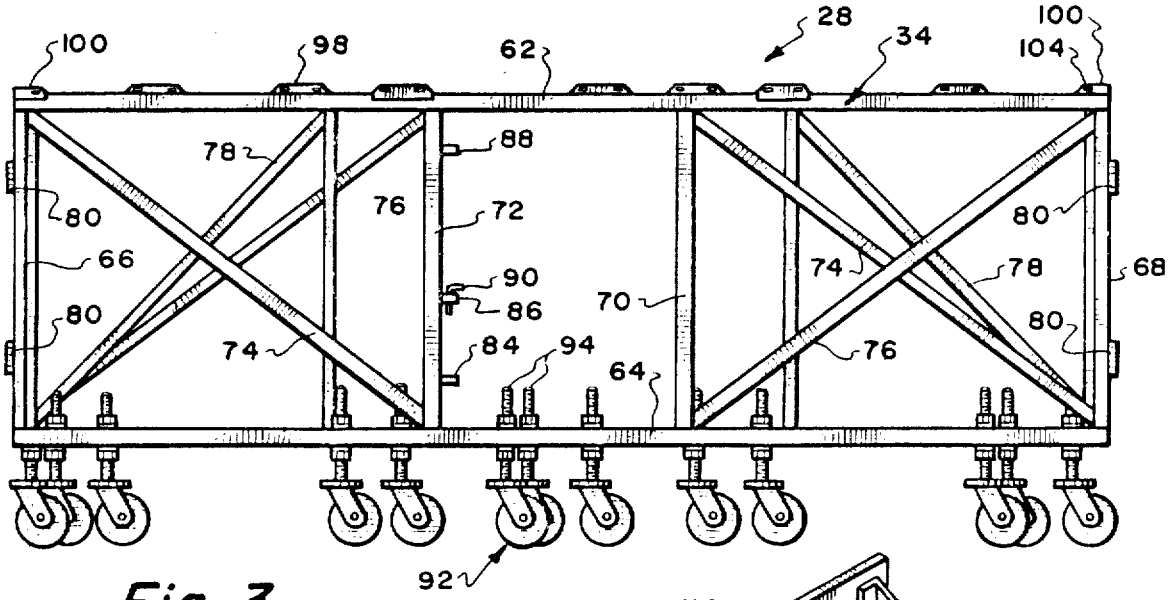
FIG. 3 is a front elevational view of the open frame assembly of FIG. 2.

Each of the side panels 34 through 60 are constructed of tubular bar stock. Each side panel has a top edge 62, a bottom edge 64, and side edges 66 and 68. The edges 62 through 68 are shown only in relation to the side panel 34 in FIGS. 3 and 7. However, it is to be understood that each side panel has a corresponding similar edges. Also, the longer side panels 34, 40, 42, 48, 54 and 60 include vertical braces 70 and 72 located between the top edge 62 and the bottom edge 64. Also included within these longer side panels are diagonal braces 74 and 76. Included within each of the shorter side panels 36, 38, 44, 46, 50, 52, 56 and 58 are only diagonal braces 78. It is to be understood that all the members of each of the side panels are welded together to form an integral unit.

Figure 2:
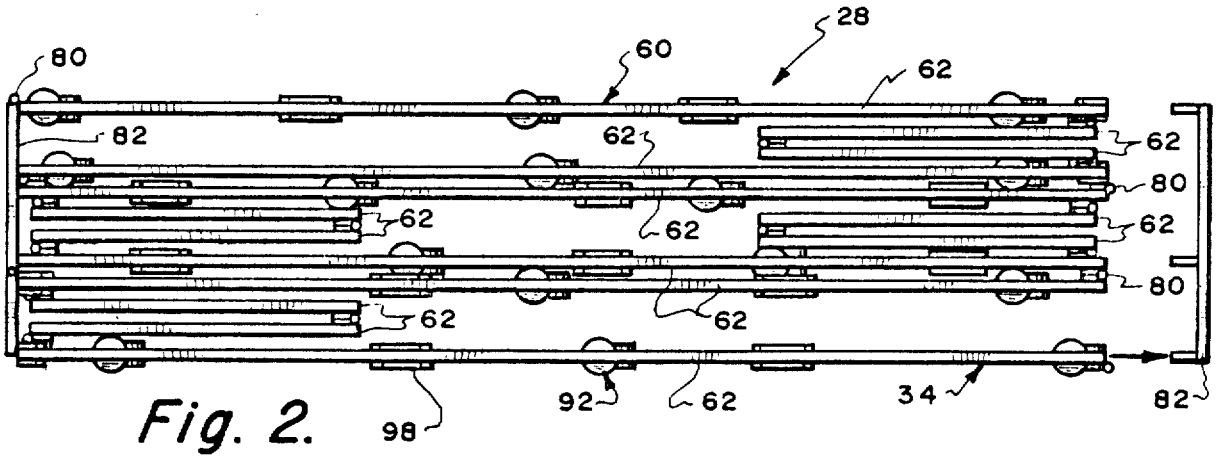
FIG. 2 is a top plan view of a single open frame assembly which is the main component of construction of the stage assembly of the present invention.

Mounted on each of the side edges 66 and 68 are a pair of spaced apart hinge barrels 80. The hinge barrels 80 mounted on the side edge 66 are permanently pivotally connected by a pivot pin with the barrels 80 mounted on the edge 68 of the side panel 36. This type of permanent hinged connection is also established between panels 36 and 38, panels 38 and 40, panels 40 and 42, panels 42 and 44, panels 42 and 50, panels 44 and 46, panels 50 and 52, panels 46 and 48, panels 52 and 48, panels 48 and 54, panels 54 and 56, panels 56 and 58, and panels 58 and 60. These side panels of the open frame assembly 58 can be located in a stowage position which is with the side panels located in juxtaposition as is shown within FIGS. 1 and 2 of the drawings.

Figure 7:
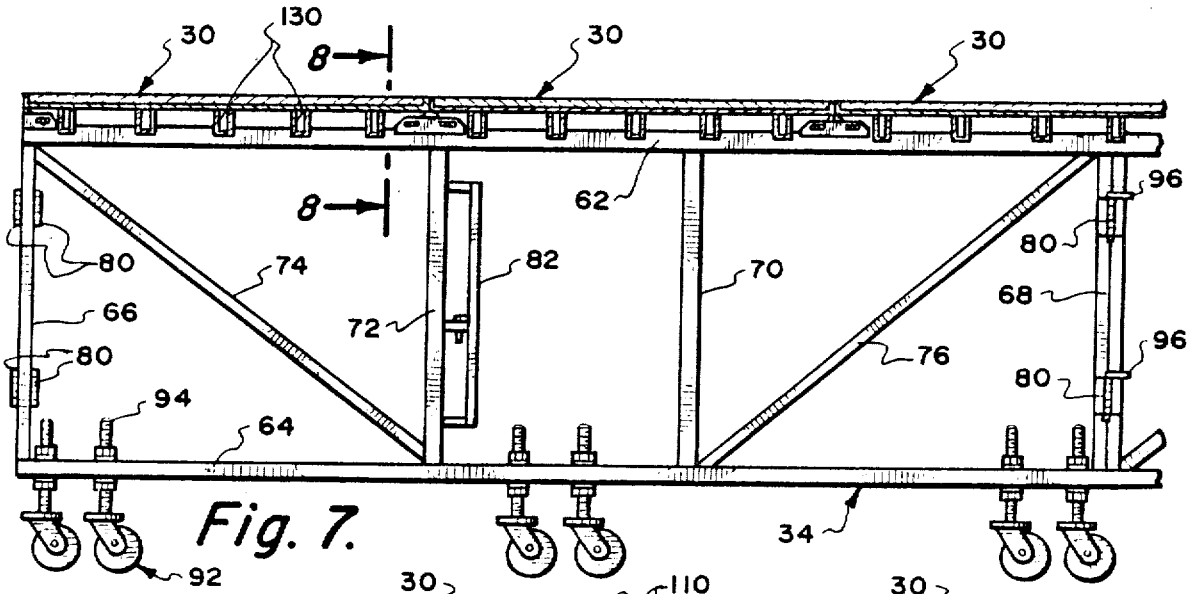
FIG. 7 is a cross-sectional view through the portable stage apparatus of the present invention taken along line 7—7 of FIG. 6.

There is provided a pair of bar members 82 which are to engage across the side panels which are located in juxtaposition so as to maintain these side panels in this stowage position. These bar members 82 are to be mountable on a pair of the vertical brace members 72 as is shown in FIG. 7 when these bar members 82 are not being used. It is to be kept in mind that the bar members 82 are only to be used when the open frame assembly 28 is in the stowage position. To stow the bar members 82 when such are not being used, the bar members 82 are to engage with protruding pins 84, 86 and 88 which are mounted on the vertical brace members 72. There is provided a pin 90 which is to be used to lock the bar member 80 into a fixed position onto the protruding pin 86.

Mounted on each of the bottom edges 34 are a plurality of caster-type wheels 92. Normally, there are three in number of caster-type wheels 92 mounted on each of the long side members 34, 40, 42, 48, 54 and 60. Each of the wheels 92 is adjustable relative to the bottom edge 34 by means of a threaded rod 94. This adjustment is provided so that the wheels 92 will evenly contact the supporting surface upon which they are located. Normally, it is not necessary to mount wheels on the bottom edge of the short panels, but if it is deemed to be desirable such wheels 92 will be so mounted.

Figure 4:
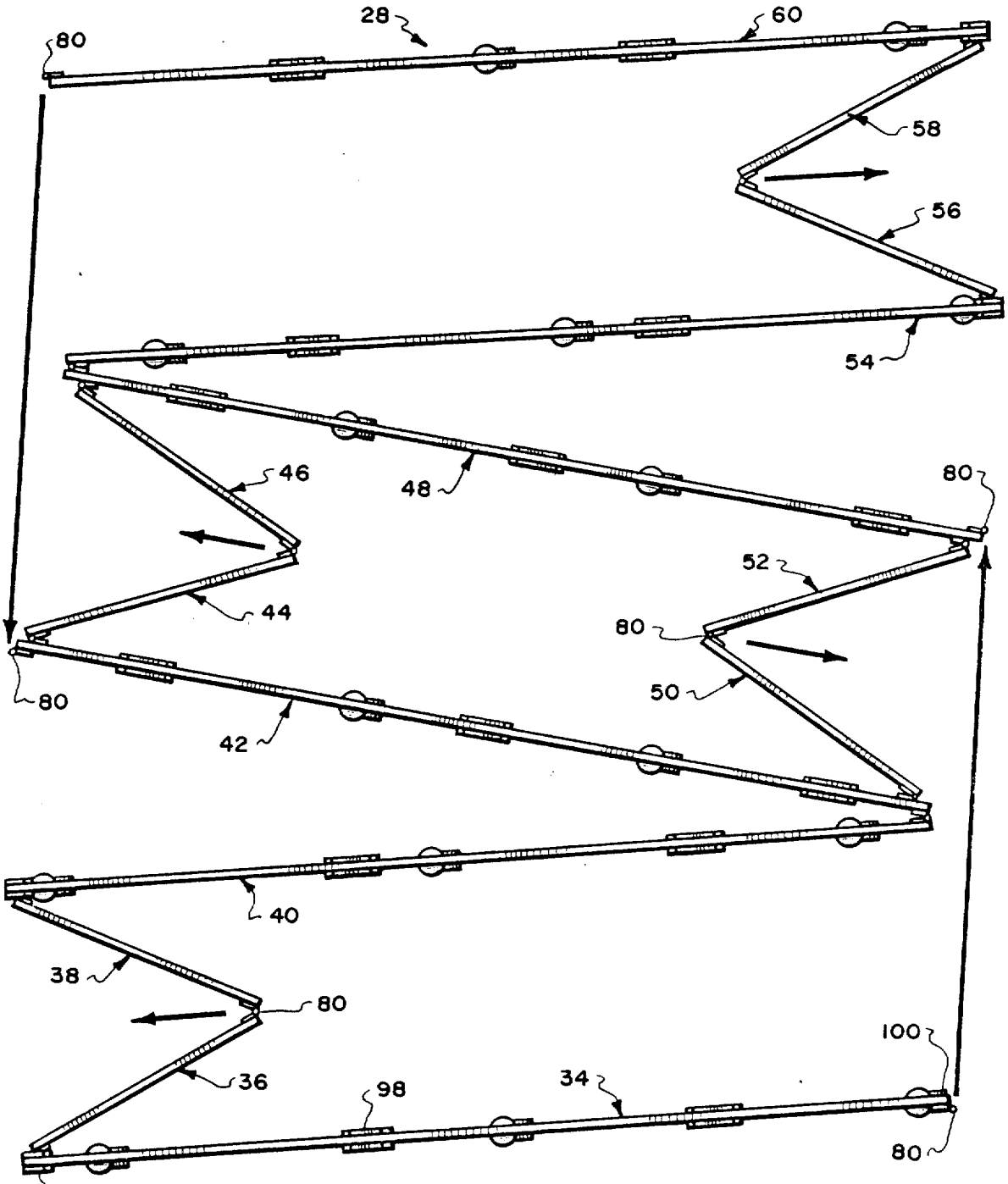
FIG. 4 is a top plan view of the open frame assembly of FIG. 2 showing the open frame assembly in an intermediate position during movement from the stowage position to the extended position.
Figure 10:
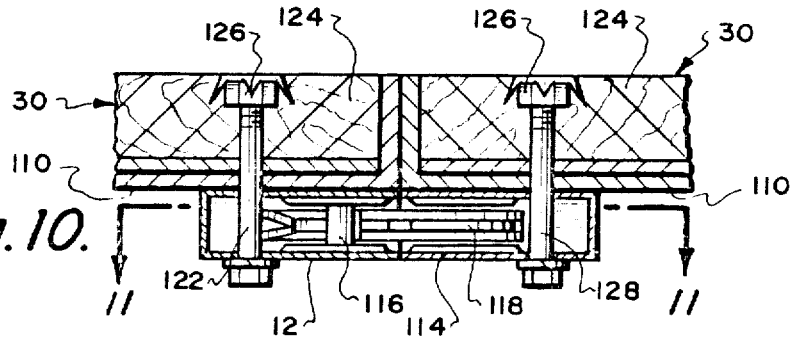
FIG. 10 is a cross-sectional view taken along line 10—10 of FIG. 6 showing in detail the separate locking device that is used to connect together abutting edges of the floor panels.
Figure 5:
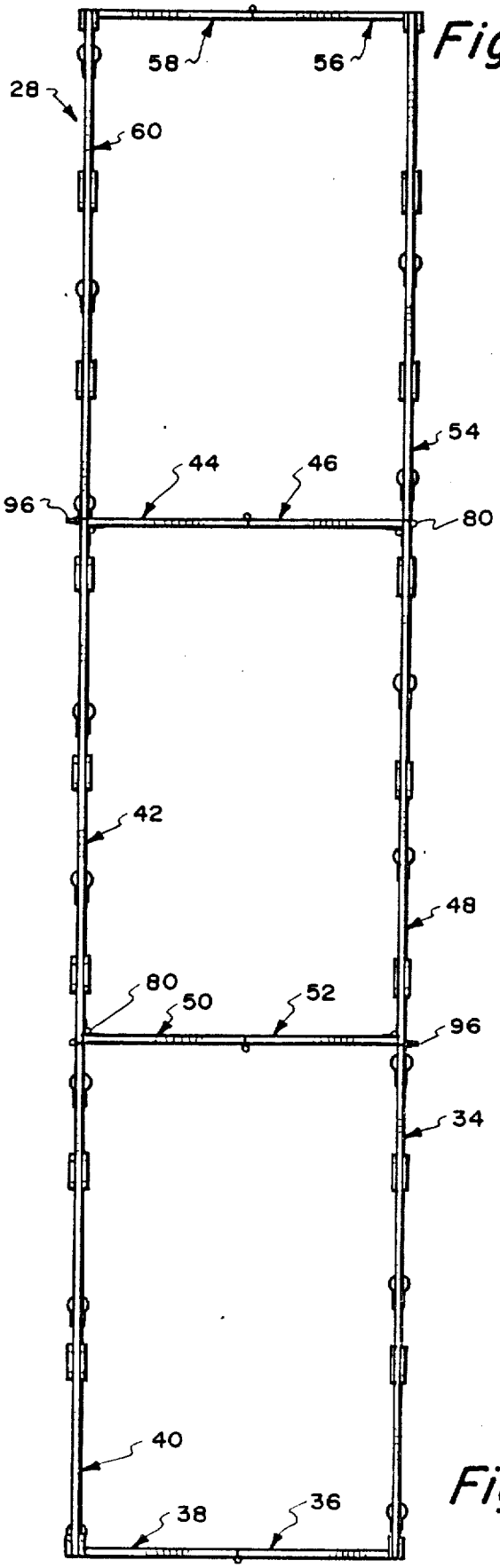
FIG. 5 is a top plan view of the open frame assembly of FIG. 4 but showing the open frame assembly in the extended position.
Figure 9:
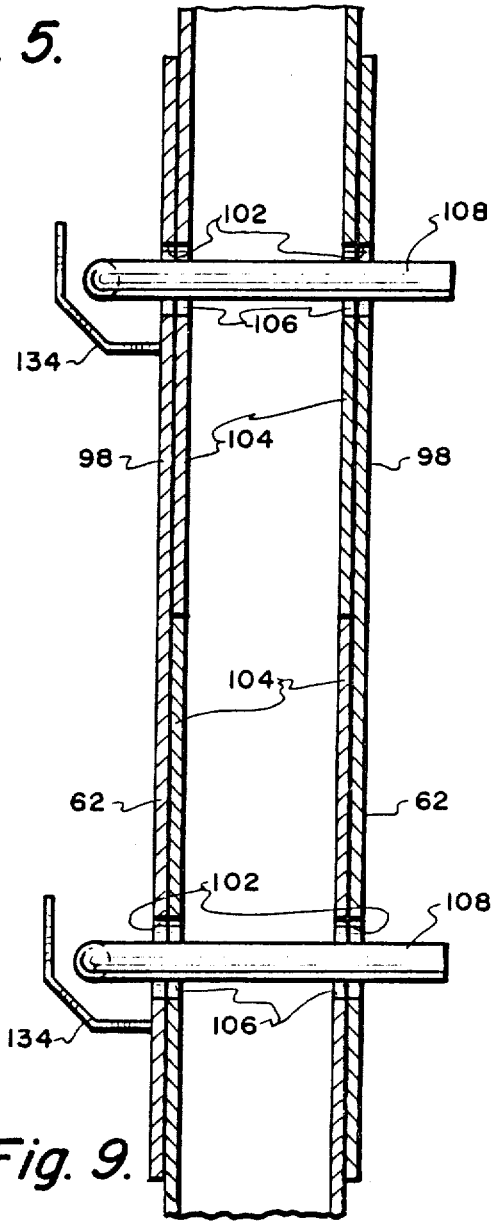
FIG. 9 is a top plan view of the locking arrangement of FIG. 8 taken along line 9—9 of FIG. 8.
Figure 11:
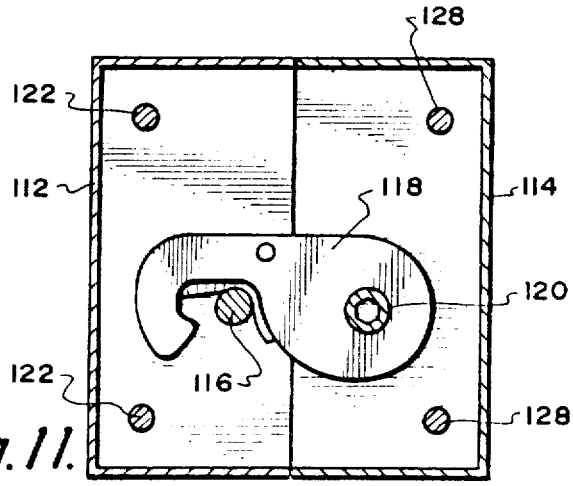
FIG. 11 is a cross-sectional view taken along line 11—11 of FIG. 10 showing the locking device in the locked position.

The wheels 92 permit movement of the side panels of the open frame assembly 28 from the stowage position to an extended position with a partially extended position being shown in FIG. 4 and a completely extended position being shown in FIG. 5. Within the completely extended position, the barrels 80 on the free edge of the side panel 34 interconnect with the barrels 80 located on one edge of the side panel 48. A pin 96 is placed within the aligned barrels 80 thereby forming a pivoting (hinge) connection. In a similar manner, the barrels 80 mounted on the free edge of the side panel 60 interconnect with the barrels 80 located on one edge of the side panel 42. Again, a pin 96 is located between the aligned barrels 80 thereby forming the desired connection between the side panels 60 and 42. The completely extended position for the frame assembly 28, when observed in a planar view, is rectangular.

Mounted along the top edge of all the side panels 34 through 60 are a plurality of double brackets 98 and a plurality of single brackets 100. The single brackets 100 are located at the edges 66 and 68. The double brackets 98 are evenly spaced along the top edge 62. It is to be noted that there are no brackets 98 and 100 on the short side members 36, 38, 44, 46, 50, 52, 56 and 58 because such are not needed. Each of the brackets 98 and 100 include holes 102 and 104 respectively.

Figure 6:
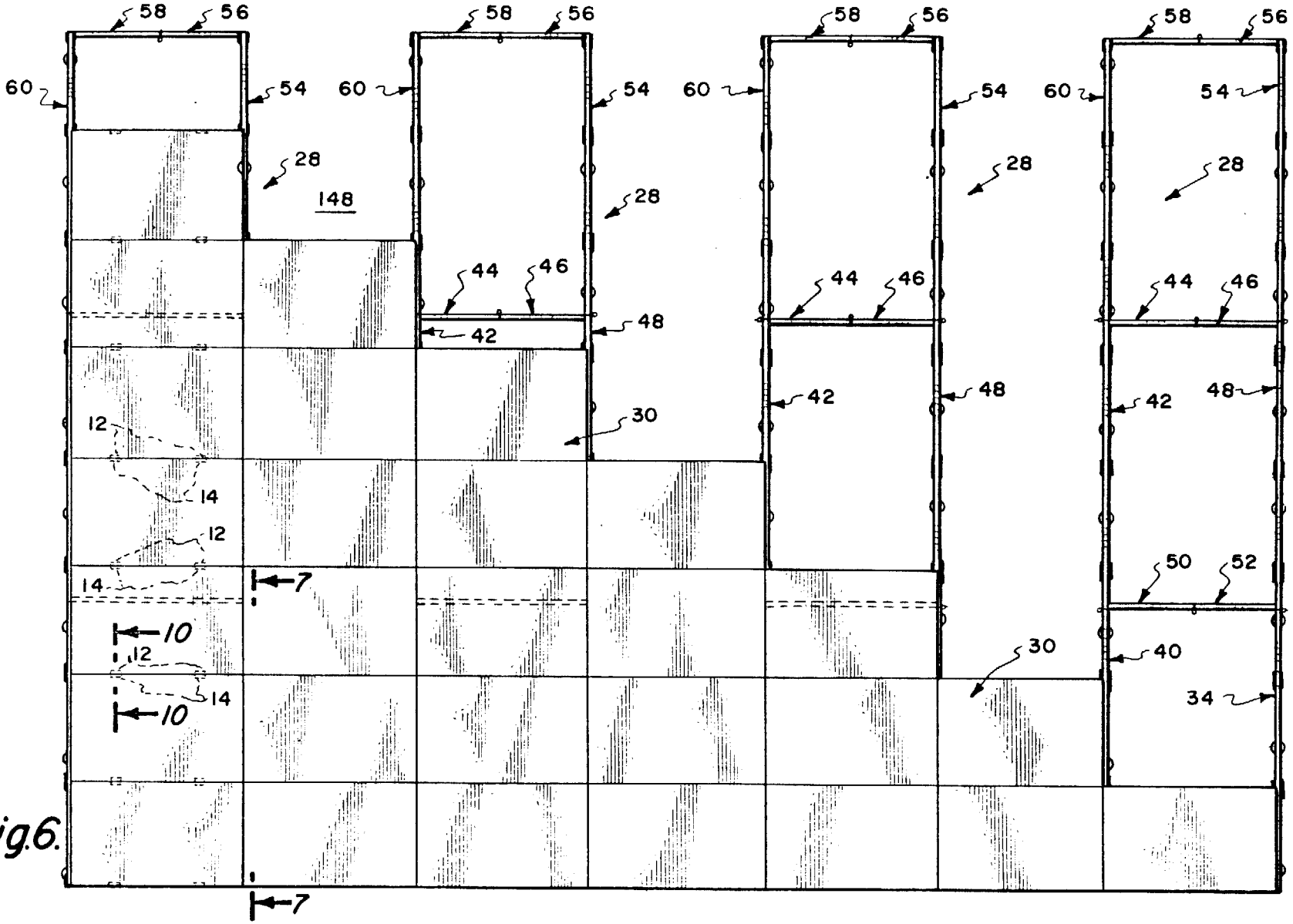
FIG. 6 is a top plan view of the entire stage apparatus which is constructed of a plurality of open frame assemblies located in an evenly spaced apart manner and with some of the floor panels being mounted on and between the open frame assembly.
Figure 8:
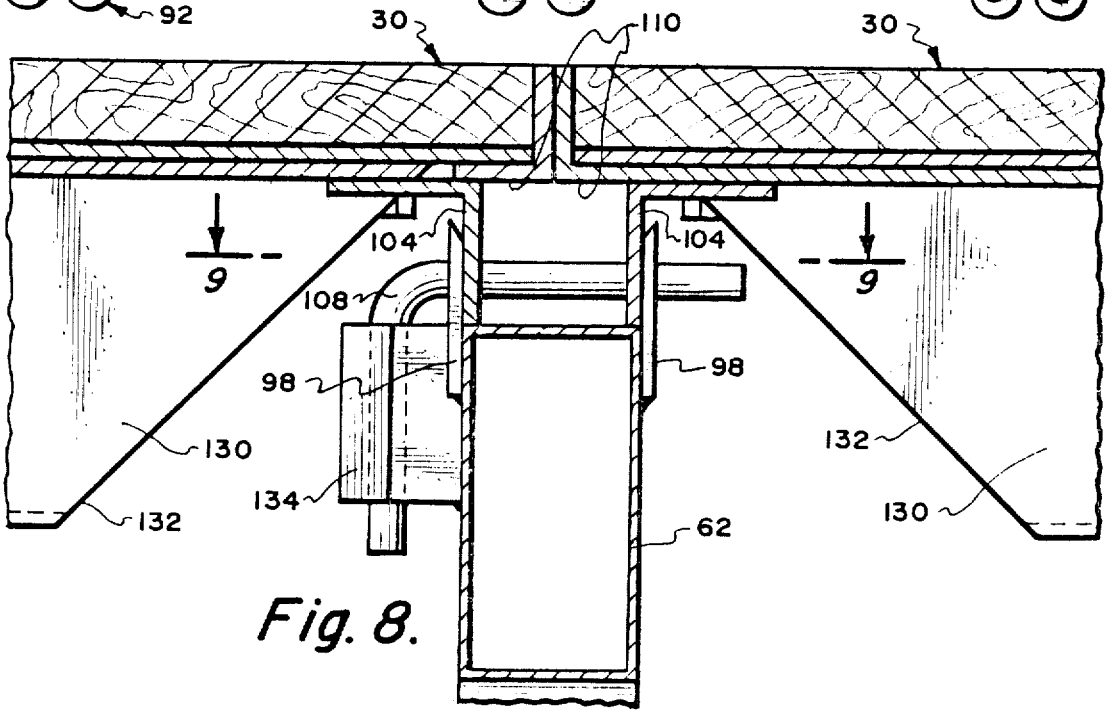
FIG. 8 is a cross-sectional view showing in more detail the locking arrangement between a side panel and a pair of floor panels taken along line 8—8 of FIG. 7.
Figure 13:
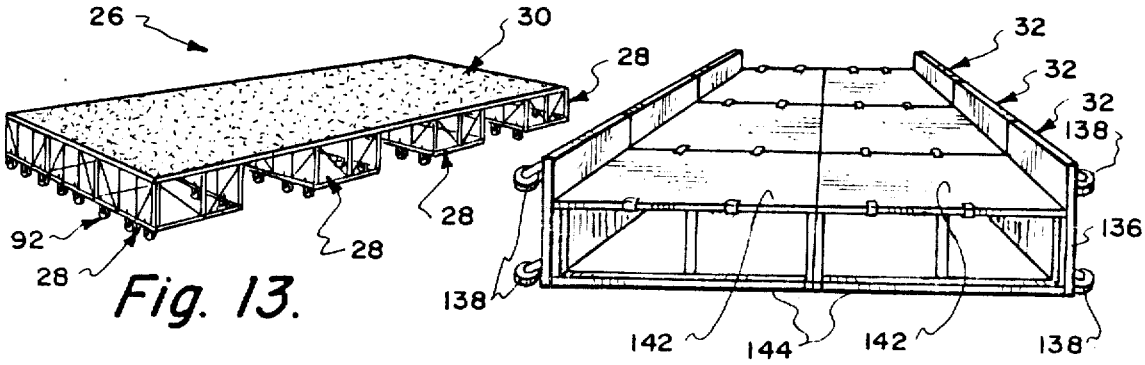
FIG. 13 is an isometric view of a completely assembled stage apparatus of the present invention showing the stage apparatus in the position ready to be used.

The bracket 98 as well as brackets 100 are each composed of two parallel spaced apart bracket members. Between these bracket members and in contact with the inside surface of one of these bracket members is to be located a flange 104. This flange 104 includes appropriate located holes 106. These holes 106 align with the holes 102 and through these aligned holes is to be conducted an L-shaped pin 108. These flanges 104 are also L-shaped with the upper leg of the flange 104 being fixedly mounted to the undersurface 110 of the floor panel 30. It is to be noted that the flanges 104 located parallel to but slightly spaced from a peripheral edge of the floor panel 30. This spacing is such that, when a flange 104 of one floor panel 30 engages with the inside surface of a bracket 98 and the flange 104 of an adjoining floor panel 30 engages with the inside surface of the other portion of the bracket 98, such as shown in FIG. 8 of the drawings, that the peripheral edges of the abutting floor panels 30 snugly contact each other. This mounting arrangement of the floor panels 30 on the frame members 28 is continued as is shown in FIG. 6 in which approximately one-half of the number of floor panels 30 are installed on the frame assemblies 28. These floor panels 30 are to continue to be mounted on the frame assemblies 28 until a completed stage apparatus 26 is created such as is shown in FIG. 13 of the drawings with the upper surfaces of the stage apparatus forming a flat surface. This snug locating of the floor panels 30 ties the entire stage apparatus 26 into a solid unit. It is to be noted that the securing of the floor panels 30 onto the frame assemblies 28 are accomplished totally by the use of pins 108 thereby not requiring the assembly of any conventional fastener such as bolts or screws.

Also, mounted on the undersurface 110 of the floor panels 30 are locks 112 and 114. Lock 112 is the female portion and includes an engageable pin 116. Lock 114 is the male portion of the lock and includes a pivotable pawl 118. The pawl 118 is to be pivoted by the use of an Allen wrench (not shown) which is to engage with socket 120.

Between abutting side edges of a pair of the floor panels 30, a lock 112 will connect with a lock 114. At that particular time, the pawl 118 is caused to be pivoted to engage with the pin 116 thereby securing together the floor panels 30.

Lock 112 is fixedly attached by bolt fasteners 122 to the wood upper surface 124 of the floor panels 30. Flushingly mounted within the upper surface of the floor panels 30 is a T-nut 126 which is to threadably engage with the fastener 122. In a similar manner, fasteners 128 are to be used to secure the lock 114 to the wooden port ion 124 which also engages with a corresponding T-nut 126.

Also fixedly mounted to the undersurface 110 of each of the floor panels 30 are a plurality of spaced apart parallel oriented tubular braces 130. The ends of each of the braces 130 is inclined forming a chamfer 132. When s floor panel 30 abuts against an adjoining floor panel 30, as is shown in FIG. 8 of the drawings, each of the braces 130 of one floor panel 30 are in direct alignment with the braces of the other floor panel 30. The chamfering 132 increases the area between each in-line pair of braces 130. This additional area is needed to provide for accessibility to the installing and the removing of the pins 108. When the pin 108 is installed in position, it is desired to pivot the pin ninety-degrees so that the outer end of the pin 108 is covered by a shield 134. The function of the shield 134 is &o prevent accidental dislodgement of any one of the pins 108.

Each frame assembly 28, when in the stowage position, is to be readily movable on the wheels 92 to any desired location such as on the bed 20 of the truck. To facilitate movement and transportability of the floor panels 30, there is utilized the transporting dolly 32. The transporting dolly 32 includes a base 136 which has an undersurface upon which is fixedly mounted a plurality of caster-type wheels 138 located directly adjacent the opposite ends of the base 136. Intermediate the ends of the base, there is also mounted some intermediate wheels 140. It is to be noted that the wheels 140 are located nearer the forward set of the wheels 138 rather than the rearward set of the wheels 138. The reason for this is that as the dolly 32 is manually moved off of a ramp (not shown) onto the surface 20, that once the forward set of the wheels 138 reaches the surface 20, the rear set of wheels 138 will be moved off of the surface of the ramp with the result that the weight of the dolly 32 is immediately transferred between the forward set of the wheels 138 and the intermediate set of wheels 140. This transfer of weight it much easier to continue to move the dolly 32 onto the surface 20.

Figure 12:
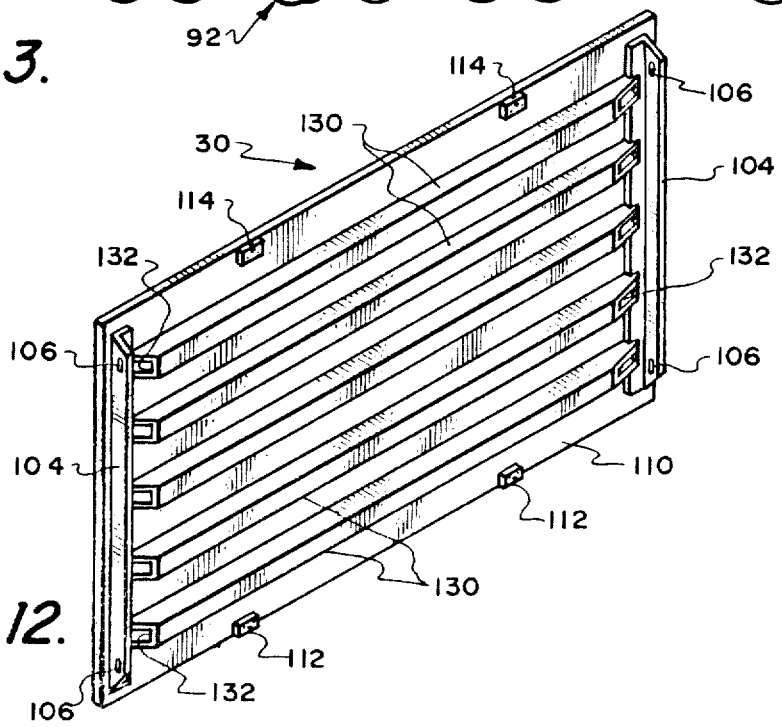
FIG. 12 is an isometric view of the undersurface of one of the floor panels used in conjunction with the portable stage apparatus of the present invention.

Fixedly mounted on the upper surface of the base 136 is a wall 142. On one side of the wall 142 is located a box-like open frame section 144. Within this open frame section 144 are to be located a plurality of the floor panels 30 with these panels 30 located on the undersurface 110 in a facing relationship. It is to be noted that when so located that the braces 130 do not directly contact one another but are actually located between one another. As is shown in FIG. 12 of the drawings, the brace located nearest the top edge of the floor panel 30 is closer to the top edge than the base 130 located nearest the bottom peripheral edge of the floor panel 30. Therefore, when the floor panels 30 are located in a reversed bottom facing position, these braces 130 are interspersed between one another and do not interfere with one another. This condenses the amount of space that is required to store a pair of the floor panels 30. This condensing of spacing is desirable so as to minimize the overall space that is required to transport the stage assembly 26 of this invention.

It is to be noted that each dolly 32 will accommodate up to twelve in number of floor panels 30 with six of the floor panels 30 being located within the open frame 144 and six of the floor panels 30 located on the opposite side of the wall 142. The floor panels 30 are to be held in place on their respective dolly 32 by means of a pair of straps 146.

When the dollies 32 are emptied of the floor panels 30 and the stage apparatus 26 is in the usable position shown in FIG. 13, the dollies 32 can be turned on their sides as shown in FIG. 14. The walls 142 can then be used as a step area making it easier for human beings to move onto and off the surface of the stage apparatus 26. Also, when the dollies 32 are in the position shown in FIG. 14 of drawings, they could be used to store equipment (not shown). Also, equipment can be stored between directly adjacent frame assemblies 38 since there is provided a through channel 148 which is covered by eight in number of the floor panels 30. It is to be understood that within the stage apparatus 26 shown within this invention that there are three in number of the channels 148.

What is claimed is:

1. A portable stage apparatus comprising:

an open frame assembly, said open frame assembly comprising a plurality of side panels, each said side panel being narrow and substantially planar defining a main plane, each said side panel being of a polygonal configuration within said main plane, each said side panel having a bottom edge and a top edge each of which are connected between a pair of said edges, said side panels being hingedly connected together at said side edges, said open frame assembly being movable between a stowage position and a use position, said stowage position being when all said side panels are located in juxtaposition, said use position being when said side panels are extended and connected together in an enclosing arrangement defining an enclosed area;

a plurality of floor panels, said floor panels being mounted on said top edges of said side panels when said open frame assembly is in said use position, said floor panels being separate from each other and disconnected from said open frame assembly when said open frame assembly is in said stowage position, each said floor panel having a substantially flat upper surface; and first locking means for securing together to a said side panel a pair of said floor panels located in an edge abutting relationship with said upper surfaces being in horizontal alignment.

2. The portable stage apparatus as defined in claim 1 wherein:

each said side panel including a plurality of wheels, said wheels being mounted on said bottom edge, said wheels being for the purpose of low-frictional movement of said side panels on a supporting surface.

3. The portable stage apparatus as defined in claim 1 wherein:

with said open frame assembly in said stowage position there being utilized a securing means to connect together said side panels and hold such in the connected together position.

4. The portable stage apparatus as defined in claim 1 wherein:

each of said floor panels being identical.

5. The portable stage apparatus as defined in claim 1 wherein:

a second locking means for securing together said floor panels.

6. The portable stage apparatus as defined in claim 1 wherein:

each said floor panel having an undersurface, a plurality of longitudinal brace members being fixedly mounted on said undersurface, said brace members being located in a spaced apart parallel arrangement, spacing of said brace members being such that upon the undersurfaces of a pair of said floor panels being placed together with the edges of said floor panels being in alignment that said brace members of both said floor panels are in direct alignment and will not interfere with one another.

7. The portable stage apparatus as defined in claim 1 wherein:

a separate wheeled dolly, said floor panels to be located on said separate wheeled dolly during movement from one locale to another.

8. A portable stage apparatus comprising:

an open frame assembly, said open frame assembly comprising a plurality of side panels, each said side panel being narrow and substantially planar defining a main plane, each said side panel being of a polygonal configuration within said main plane, each said side panel having a bottom edge and a top edge each of which are connected between a pair of side edges, said side panels being hingedly connected together at said side edges, said open frame assembly being movable between a stowage position and a use position, said stowage position being when said side panels are located in juxtaposition, said use position being when said side panels are extended defining an enclosed area;

a plurality of floor panels, said floor panels being mounted on said top edges of said side panels, each said floor panel having a substantially flat upper surface;

first locking means for securing together to a said side panel a pair of said floor panels located in an edge abutting relationship with said upper surfaces being in horizontal alignment; and said first locking means comprising a pin, said pin to connect with aligned openings formed between a said floor panel and a said side panel.

9. The portable stage apparatus as defined in claim 8 wherein:

each said side panel including a pin retainer associated with each said first locking means, said pin to be movable to connect with said pin retainer when said pin is in the position securing together a said floor panel to a said side panel.

10. A portable stage apparatus comprising:

an open frame assembly, said open frame assembly comprising a plurality of side panels, each said side panel being narrow and substantially planar defining a main plane, each said side panel being of a polygonal configuration within said main plane, each said side panel having a bottom edge and a top edge each of which are connected between a pair of side edges, said side panels being hingedly connected together at said side edges, said open frame assembly being movable between a stowage position and a use position, said stowage position being when said side panels are located in juxtaposition, said use position being when said side panels are extended defining an enclosed area;

a plurality of floor panels, said floor panels being mounted on said top edges of said side panels, each said floor panel having a substantially flat upper surface;

first locking means for securing together to a said side panel a pair of said floor panels located in an edge abutting relationship with said upper surfaces being in horizontal alignment;

each said floor panel having an undersurface, a plurality of longitudinal brace members being mounted on said undersurface, said brace members being located in a spaced apart parallel arrangement, spacing of said brace members being such that upon the undersurfaces of a pair of said floor panels being placed together with the edges of said floor panels being in alignment that said brace members of both said floor panels will not interfere with one another and be located in an alternating aligned arrangement; and each said brace member having a pair of ends, each said end of each said brace member being chamfered, with a pair of said floor panels being connected together with said flat upper surfaces in alignment therebeing created a gap area between aligned brace members of one said floor panels, a said first locking means to be located within a said gap area.

11. The portable stage apparatus as defined in claim 7 wherein:

said first locking means comprising a pin, said pin to connect with aligned openings formed between a said floor panel and a said side panel.

12. The portable stage apparatus as defined in claim 11 wherein:

each said side panel including a pin retainer associated with each said first locking means, said pin to be movable to connect with said pin retainer when said pin is in the position securing together a said floor panel to a said side panel.

13. The portable stage apparatus as defined in claim wherein:

a second locking means for securing together said floor panels.

14. The portable stage apparatus as defined in claim 13 wherein:

each said side panel including a plurality of wheels, said wheels being mounted on said bottom edge, said wheels being for the purpose of low-frictional movement of said side panels on a supporting surface.

15. The portable stage apparatus as defined in claim 14 wherein:

with said open frame assembly in said stowage position there being utilized a securing means to connect together said side panels and hold such in the connected together position.

* * * * *